US007290291B2

(12) United States Patent
Anderson et al.

(10) Patent No.: US 7,290,291 B2
(45) Date of Patent: Nov. 6, 2007

(54) MITT

(76) Inventors: Douglas D. Anderson, 583 Shoshone, Grand Junction, CO (US) 81509; Seth I. Anderson, 1412 Ouray Ave., Grand Junction, CO (US) 81501

( * ) Notice: Subject to any disclaimer, the term of this patent is extended or adjusted under 35 U.S.C. 154(b) by 51 days.

(21) Appl. No.: 11/281,046

(22) Filed: Nov. 16, 2005

(65) Prior Publication Data

US 2006/0075539 A1 Apr. 13, 2006

Related U.S. Application Data

(63) Continuation-in-part of application No. 10/079,118, filed on Feb. 20, 2002, now Pat. No. 6,996,847.

(51) Int. Cl.
*A41D 19/00* (2006.01)

(52) U.S. Cl. ..... 2/159; 2/158; 2/161.1; 2/161.2; 2/161.3; 2/161.4; 2/161.5; 2/161.6; 2/161.7; 2/161.8; 2/163

(58) Field of Classification Search ..... 2/159, 2/161.1, 161.2, 161.3, 161.4, 161.5, 161.6, 2/161.7, 161.8, 163
See application file for complete search history.

(56) References Cited

U.S. PATENT DOCUMENTS

| | | | | |
|---|---|---|---|---|
| 1,400,655 | A * | 12/1921 | Bohnert | 2/158 |
| 2,128,796 | A | 9/1938 | Bohm-Myro | 2/158 |
| 2,274,335 | A | 2/1942 | Kennedy | 2/158 |
| 2,315,889 | A | 4/1943 | Wells | |
| 2,323,136 | A | 6/1943 | Johanson | 2/158 |
| 2,340,017 | A | 1/1944 | Rasmussen | 2/270 |
| 2,603,790 | A | 7/1952 | Bohm-Myro | 2/158 |
| 2,609,543 | A * | 9/1952 | Farrell | 2/158 |
| 2,836,828 | A | 6/1958 | Henrikson | 2/158 |
| 3,214,771 | A | 11/1965 | Treiber | 2/270 |
| 3,299,441 | A | 1/1967 | Slimovitz | 2/158 |
| 3,403,408 | A | 10/1968 | Helfer | 2/158 |
| 4,195,405 | A | 4/1980 | Monk | 2/158 |
| 4,359,784 | A | 11/1982 | Harrington | 21/169 |
| 4,383,336 | A | 5/1983 | Beckman et al. | 2/158 |
| 4,559,647 | A | 12/1985 | Smith et al. | |
| 4,651,350 | A | 3/1987 | Dawiedczyk | 2/158 |

(Continued)

*Primary Examiner*—Gary L. Welch
*Assistant Examiner*—Alissa J Tompkins
(74) *Attorney, Agent, or Firm*—Allen H. Erickson

(57) ABSTRACT

An improved mitt for cold weather use is configured to provide a variety of modes of wear. The mitt is convertible between a fully closed position for covering the hand and fingers and open positions for exposure of the thumb and/or finger(s) or the entire hand. An internal pocket within the mitt permits continuous or intermittent warming of all or some of the fingers when the mitt is in either a generally open position or closed position. Insertion and removal of fingers and thumb relative the internal pocket is easily accomplished without use of the other hand. A thumb hole and/or finger hole for thumb/finger exposure is formed with an overlapping two-layer seal of stretchable material to prevent heat loss while ensuring easy thumb/finger insertion and removal. In one embodiment, stretchable fillets connect the terminal ends of the palm side and back side of the mitt to provide a snug fit about the wrist. The wearing modes include full exposure of a hand, exposure of the thumb and/or a finger(s), exposure of the four finger tips, and full hand coverage.

14 Claims, 7 Drawing Sheets

U.S. PATENT DOCUMENTS

| | | | | |
|---|---|---|---|---|
| 4,698,850 | A | 10/1987 | Patton, Sr. et al. | 2/159 |
| 4,742,579 | A * | 5/1988 | Dunford | 2/160 |
| 4,756,027 | A | 7/1988 | Buenos et al. | 2/123 |
| 4,805,338 | A | 2/1989 | Schublom | 2/158 |
| 4,933,992 | A | 6/1990 | Kallman | 2/160 |
| 4,944,041 | A | 7/1990 | Buenos et al. | 2/84 |
| 5,125,117 | A | 6/1992 | Buenos et al. | |
| 5,172,427 | A | 12/1992 | Van Bergen et al. | 2/158 |
| 5,444,874 | A | 8/1995 | Samelian et al. | |
| 5,504,944 | A | 4/1996 | Bromer et al. | 2/269 |
| 5,517,693 | A | 5/1996 | Noonan | 2/159 |
| 5,673,836 | A | 10/1997 | Bush | 224/576 |
| 5,678,248 | A | 10/1997 | Lengyel | 2/158 |
| 5,774,894 | A | 7/1998 | Yates et al. | 2/158 |
| 5,794,265 | A | 8/1998 | Reich | 2/125 |
| 6,076,189 | A | 6/2000 | Christman et al. | 2/158 |
| 6,253,381 | B1 | 7/2001 | Kelley | 2/125 |
| 6,449,772 | B1 * | 9/2002 | Donner | 2/170 |

* cited by examiner

MITT

This is a continuation-in-part of application Ser. No. 10/079,118 filed Feb. 20, 2002 now U.S. Pat. No. 6,996,847.

BACKGROUND OF THE INVENTION

1. Field of the Invention

The present invention relates to hand coverings. More specifically, the invention relates to modified mitts which are separately worn or are integrated into upper body garments, and which may be worn in a variety of different modes to accommodate a wide range of atmospheric conditions and activities of the wearer.

2. State of the Art

The need for warm upper body garments, e.g. coats and jackets, has always been important for humanity. In regions which experience cold temperatures, it has been found that heat transfer from a person's head and extremities, e.g. arms and legs (particularly the hands and feet) is most critical. This is because the ratio of surface area to mass is highest in these areas, and human activity is often predicated upon having at least a portion of the head and hands being exposed, i.e. uncovered at times. This is true of many outdoor winter activities which are becoming very popular, such as skiing, ski-touring, ice climbing, mountain climbing, rock climbing, ice sailing, skating, ice fishing, hunting, snowmobiling, snowshoeing, winter camping and the like.

In cold-weather use of an upper body garment such as a jacket or coat, heat transfer from a wearer's body typically occurs in several specific areas. First, there is general heat transfer through the body and arms of the garment. This heat loss may be controlled by varying the insulative value of the coat material, and/or as commonly practiced, by layering of shirts, sweaters, etc. under the outer garment. Secondly, there is heat loss by movement of air through the space between the lower extremity of the coat and the person's waist. This heat loss may be controlled by varying the tightness of the coat about the person's waist. Thirdly, there is heat loss from exposure of the wearer's head, which in many cases is the major source of heat loss from a wearer's upper body. Control of the head area which is exposed, and varying the insulative properties of the head covering, are two methods used to effect a desired head temperature. Fourthly, heat transfer from the hands and lower arms is also very important. Most cold weather activities require the uncovering of the fingers or the entire hand at times, or use of a fingered glove in place of a mitten.

In the field of upper body garments, headwear and handwear, the art is filled with a plethora of designs and configurations of hand coverings and head coverings which may be used with or be a part of a cold weather jacket. These prior art apparel were generally intended to providing a particular function. Some of the hand coverings provide for alternative use as mittens and fingered gloves.

U.S. Pat. No. 5,076,189 to Christman et al., a garment is shown with cuffs which are retractable over inner gloves to provide additional warmth, or alternatively, cooling, to the fingers.

U.S. Pat. Nos. 4,756,027 and 4,944,041 to Buenos et al. shows a similar arrangement, wherein an inner glove portion in the garment sleeve has finger chambers with ends which fold backward to expose the fingertips.

In U.S. Pat. No. 2,340,017 to Rasmussen, an outer garment or coat for a child is shown with attached mittens with integral slide fasteners which are configured to prevent a child from opening thereof without removing the garment.

U.S. Pat. No. 5,504,944 to Bromer et al. discloses a jacket sleeve with an opening through which a thumb may be placed to retain the sleeve over a portion of the hand, when no mittens or gloves are used.

In U.S. Pat. No. 2,274,335 to Kennedy, a mitten is shown with a full-width aperture in the palm, permitting a user's fingers to slide out of the mitten to handle keys, tickets and the like. A welt along the edge of the aperture serves to close the aperture and provide a supplemental grip for grasping a steering wheel.

U.S. Pat. No. 5,678,248 to Lengyel and U.S. Pat. No. 4,383,336 to Beckman et al. disclose mittens having a slitted end for extending one's fingertips out of the mitten. In order to maintain the fingers covered, the fingers must be folded within the mitten. In U.S. Pat. No. 5,172,427 to Van Bergen et al., the mitten is sufficiently large for maintaining the fingers in an unfolded state.

U.S. Pat. No. 3,403,408 to Helfer describes a hand covering having an inner glove covered by an outer mitten having a full-width slit through which the glove's fingers may be extended.

In U.S. Pat. No. 3,299,441 to Slimovitz, a hand covering similar to that of Helfer has a slitted mitten whereby the fingertips may be extended through the slit.

In U.S. Pat. No. 5,673,836 to Bush, a mitt is shown in which the distal end is closed by a VELCRO® member so that the finger ends may be exposed when desired.

A similar mitt is shown in U.S. Pat. No. 4,805,338 to Schublom. In this patent, the mitt has adjoining break-apart edges which may be peeled back to expose a user's hand.

In U.S. Pat. No. 4,933,992 to Kallman, an attachment for a glove is described which slides over the back surface of the glove and is held there by several straps. The attachment includes portions which slip over the fingers and thumb of the glove to provide added insulation, and includes space for storing keys, money, etc.

A variety of other openable mitts/gloves are found in the prior art. For example, mittens having a substantial terminal portion closable by a zipper are described in U.S. Pat. Nos. 2,128,796 and 2,603,790 to Bohm-Myro and U.S. Pat. No. 4,359,784 to Harrington.

U.S. Pat. No. 2,323,136 to Johanson, U.S. Pat. No. 2,836,828 to Henrikson, and U.S. Pat. No. 4,195,405 to Monk describe soft fabric mittens in which slots permit protrusion of a user's fingers or gloved fingers through the mitten fabric.

In U.S. Pat. No. 3,214,771 to Treiber, a mitten is contained in a zippered pocket in a coatsleeve. The mitten may be retracted and positioned over the cuff for wear.

U.S. Pat. No. 4,651,350 to Dawiedczyk shows a work glove which has open truncated finger portions and a thumb portion with an intermediate hole. A half mitten is attached to the back of the glove and may be pivoted forward to cover the exposed fingers.

U.S. Pat. No. 5,774,894 to Yates et al. shows a thermal mitten for golfers in which a finger enclosure contains an in-wall heating device. The finger enclosure may be folded back and attached to the lower portion of the mitten by a VELCRO strip.

In U.S. Pat. No. 5,517,693, to Noonan, a hand covering is depicted which has an L-shaped palmar slot with a flap to seal the slot. The wearer's hand may be extended through the slot for exposure.

U.S. Pat. No. 4,698,850 to Patton, Sr. et al. describes a therapeutic exercise glove with a finger enclosure adjustably attached by straps to a palmar region to position the fingers in a desired bent-forward bent-backward position for therapy.

U.S. Pat. No. 4,559,647 to Smith et al. discloses a scarf having a mitten at each end. A fold-over pocket fully surrounds the cuff.

U.S. Pat. No. 5,444,874 to Samelian et al. depicts a hand covering which permits easy egress of a hand therefrom. Three temporarily securable flaps on the back portion may be opened to enable egress; the glove then hangs loosely from the wrist.

U.S. Pat. No. 2,315,889 to Wells shows a mitten in which the portion covering the fingers may be swung open to uncover the fingers. The finger covering portion may be held closed by a snap, and when open, is not prevented from freely swinging.

U.S. Pat. No. 5,125,117 to Buenos et al. discloses a 360 degree cuff which folds in upon itself and is retained in position by "Velcro" material. No interior pocket is shown.

In U.S. Pat. No. 5,794,265 to Reich, a hand-protective article is described which includes a full-size thumb hole for exposing a user's thumb. No hole closure means is disclosed.

U.S. Pat. No. 6,253,381 to Kelley discloses sleeved apparel having gloves or mittens sewn into the cuff interior, and an exterior thumb covering which is retractable into the cuff.

None of the above references provides a unitary hand covering which may selectively function as an open sleeve, thumbed open sleeve, fingerless glove, full glove, or full mitten with optional exposure of a thumb or trigger finger.

BRIEF SUMMARY OF THE INVENTION

The present invention is, in one embodiment, an improved mitt for temperature protection of a person's hands. The mitt may be configured for separate wear, or alternatively may be incorporated into the sleeve of an upper body garment such as a jacket, coat, shirt or vest. Typically, the mitt is configured for cold-weather use where large temperature variations may be encountered, and physical exertion of the hands is required. Thus, the mitt is uniquely designed to be used in a variety of ways to achieve a desired combination of warmth, comfort and dexterity. The hand covering i.e. mitt may be formed of a pliable and/or non-pliable material, preferably one or more types of stretchable fabrics such as a fleece or a hard-surfaced fleece, in combination with a "shell" type material such as polytetrafluoroethylene (PTFE), including fabric products which are trademarked under the name GORTEX®. A variety of other fabrics may also be used, at least a portion of which must have high 2-way or 4-way stretch properties. The hand coverings of the invention may be combined in various configurations in combination with various garment types, i.e. coat, jacket, shirt, vest, and vest with attachable/detachable arms, etc.

The hand coverings comprise mittens which are formed to be multi-modal such that they may be worn to achieve various combinations and degrees of exposure for each of the hand, the thumb and the four fingers. The hand coverings may be terminal portions of the garment sleeves, or may be separate mittens which may be worn together with a jacket or other garment, or may be worn independently of any particular body garment. An improvement of the present invention is the addition of an interior finger-protecting pocket within the cuff of each mitt, wherein one or more fingers may be readily protected while operating with an open-ended cuff. Another improvement is a two-part flexible insulative overlapping covering for a finger hole or thumb hole. The flexible covering prevents heat loss through the hole, but permits easy insertion and removal of the digit. In another improvement, the terminal corner portions of the palm and backside panels are joined by generally triangular fillets comprising stretchable insulative material.

In one embodiment, the hand covering comprises a fabric tube with a full or substantially full end opening. The end opening is closeable by a 2-way external pocket which may be flipped between the mitten's backside (to form a fully closed mitten) and the mitten's palmside, where it covers a thumb enclosure but opens the end opening for full or partial hand exposure. A thumb enclosure may be used whereby only the wearer's fingertips (excluding thumb) are exposed. A second optional feature is a thumbhole proximate the end opening whereby the thumb may be independently exposed. Similarly, a finger hole for e.g. a trigger finger, may be formed whereby a finger may be exposed independently of the thumb and other fingers.

A second embodiment is similarly formed, but in addition has glove finger enclosures open to the tube and storable under the 2-way pocket. With the 2-way pocket flipped to the mitten's backside, the glove finger enclosures may be configured as one enclosure for each of the four fingers, or enclosures for 1 and/or 2 and/or 3 fingers of the wearer. This embodiment is useful where particular fingers are used to perform particular tasks such as in riflery, archery, outdoor electrical work, and the like.

In one version of the garment, a jacket with a hood and face shield has arms which are attached by zippers or other attachment devices such as hook-and-loop strips sold under the trademark Velcro®, and the like. The cuffs of the arms may include thumb holes, hook-and-loop (e.g. Velcro®) tightening strips, or hand coverings of any of the embodiments described herein.

The mitt may be formed of a variety of materials, such as artificial fleece, hard-faced fleece, shell material such as PTFE and other similar materials, including both highly elastic materials and low elastic materials.

The features of the invention provide enhanced versatility to the mitt, whether used separately or incorporated in a garment. Use under a variety of atmospheric conditions including severe cold and high wind is enabled. A user may expose part or all of a hand or hands for performing a particular task, but retain the remainder of his hand(s) in a weather-protected state. Rapid switching from an exposed condition to a protected condition is separately possible with each hand, without requiring assistance of the opposite hand. Removal of mitts is not required for performing bare hand tasks, avoiding mitt misplacement and loss. The mitt of the invention is particularly useful when participating in strenuous or dangerous sports, permitting adjustment of hand/finger dexterity and thermal coverage of hands during the participation. Loss of garment items (such as mittens) under high stress activities, e.g. mountain climbing, is eliminated or greatly reduced, and wearer comfort is maintainable at all times. In addition, the mitt is very light in weight, enhancing a wearer's performance under conditions of stress.

BRIEF DESCRIPTION OF THE SEVERAL VIEWS OF THE DRAWINGS

The nature of the present invention may be more clearly understood by reference to the following detailed description of the invention, to the appended claims, and to the several drawings herein, wherein:

FIGS. 2, 3 and 4 are general perspective views of mitt embodiments having separate finger portions in accordance with the present invention; wherein:

FIG. 2 depicts a mitt with separate thumb and four finger enclosures;

FIG. 3 depicts a mitt with a separate enclosure for the first ("trigger") finger;

FIG. 4 depicts a mitt with separate enclosures separating the first and second fingers from the third and fourth fingers;

DETAILED DESCRIPTION OF THE INVENTION

Figure 1:
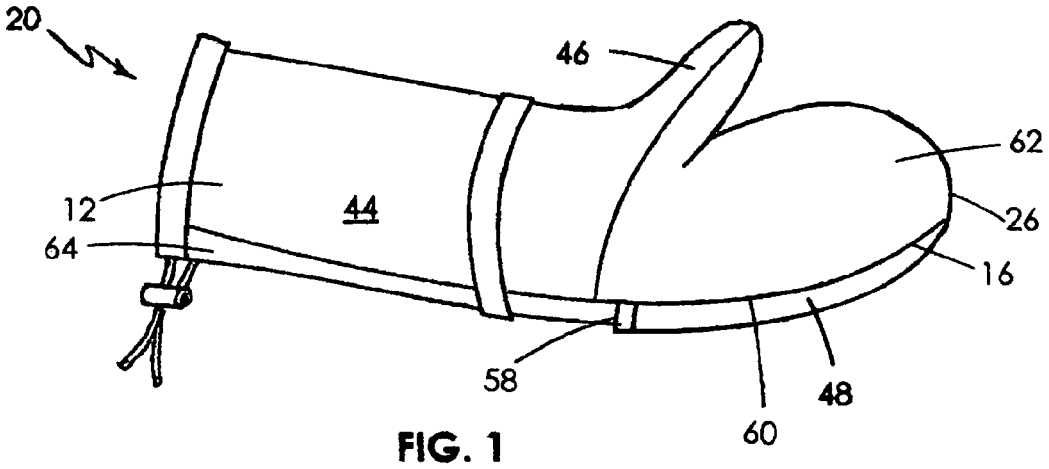
FIG. 1 is a general perspective view of a first exemplary embodiment of a mitt in a hand-enclosing position in accordance with the invention.
Figure 21:
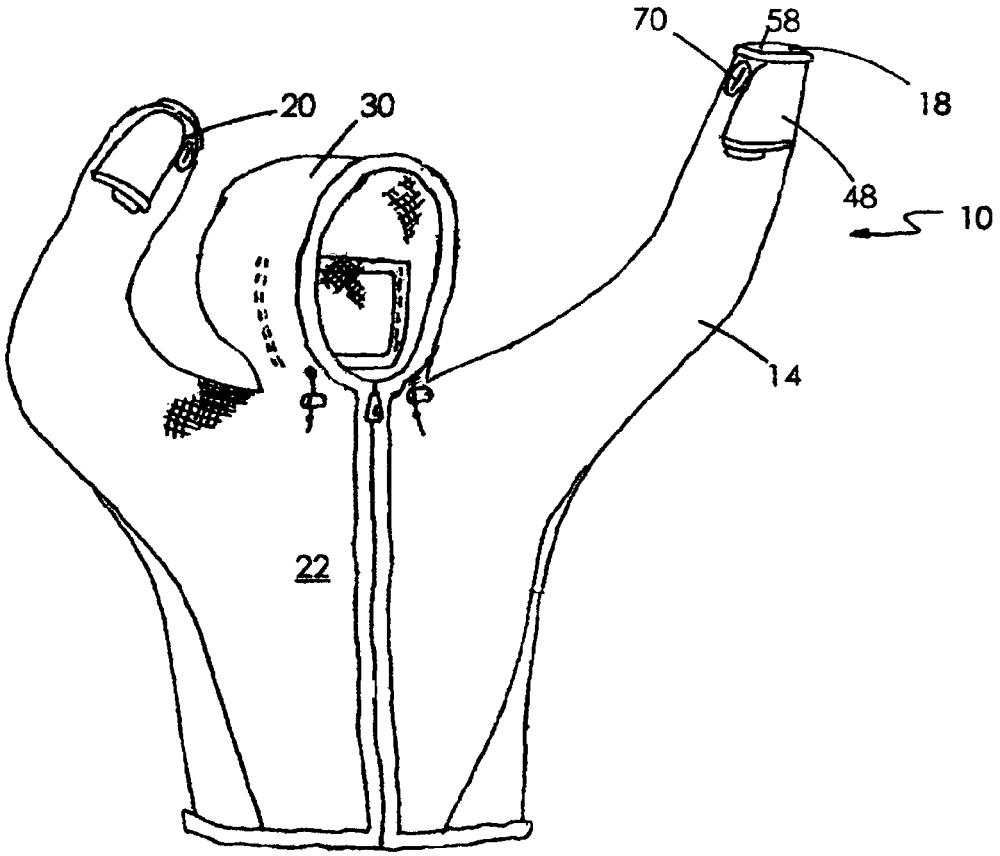
FIG. 21 is a front view of an upper body garment having arms with integral mitts in accordance with the invention.

Now referring to FIG. 1 of the drawings, a first exemplary embodiment of a multi-mode mitt 20 according to the invention is depicted. The mitt 20 is shown having an upper tubular portion 44 through which a person's arm passes. The tubular portion may be formed of a backside 64 and a palm side 12. A thumb enclosure 46 extends outwardly from the palm side 12. A terminal opening 18 of tubular portion 44 is, in this mode, covered by a two-way outer pocket 48 which has its outer periphery 60, except for the pocket opening 58, attached to the peripheral seam 16 about palm portion 18. Outer pocket 48 may be folded over the terminal end 26 of the mitt 20 to cover the palm portion 18 and expose terminal opening 18 to the atmosphere. Although the embodiment of FIG. 1 is shown as a separately-worn hand covering 20, it may alternatively be an integral part of an arm of an upper body garment (see FIG. 24). In FIG. 24 for example, a jacket 10 with a hood 30 and a front 22 has jacket arms 14 which terminate in hand coverings 20 of the invention. The mitt 20 is shown in a mode wherein a user's hand may be extended through terminal opening 18.

Figure 2:
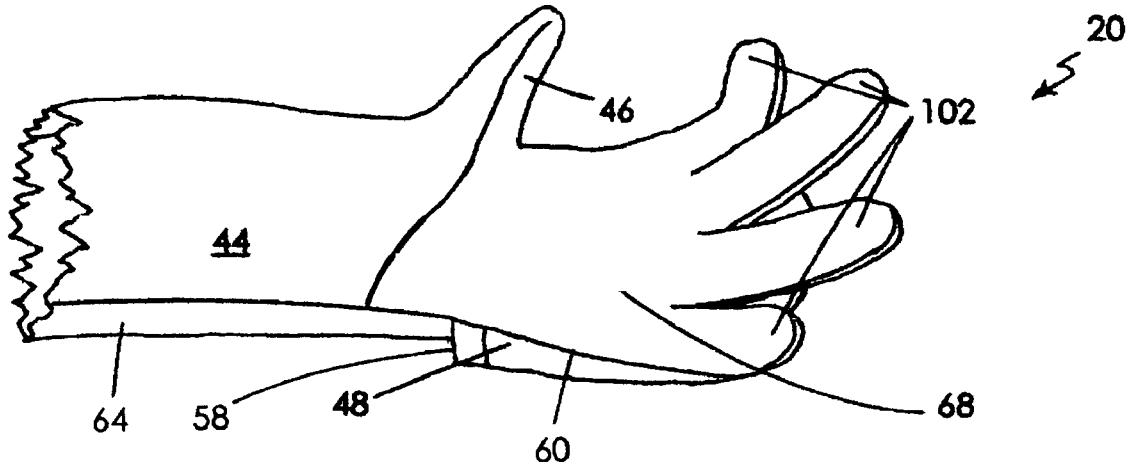
Figure 3:
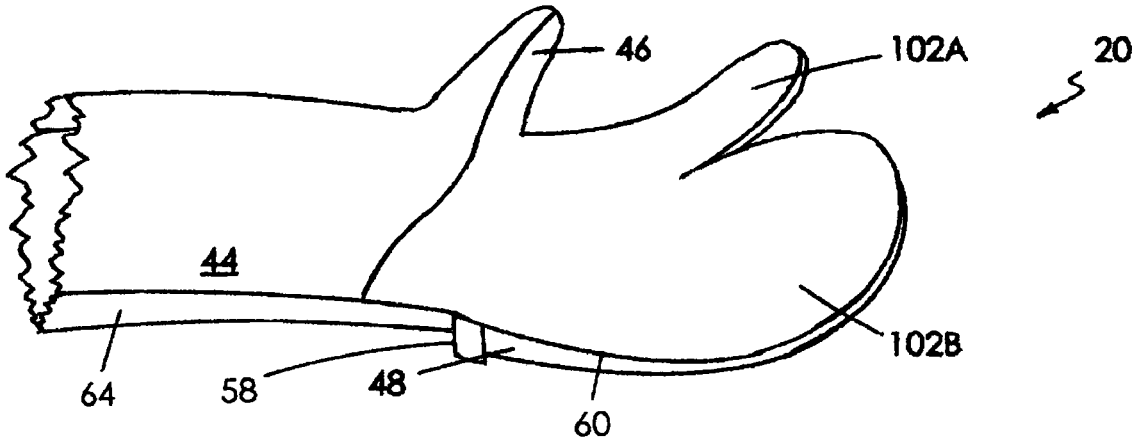
Figure 4:
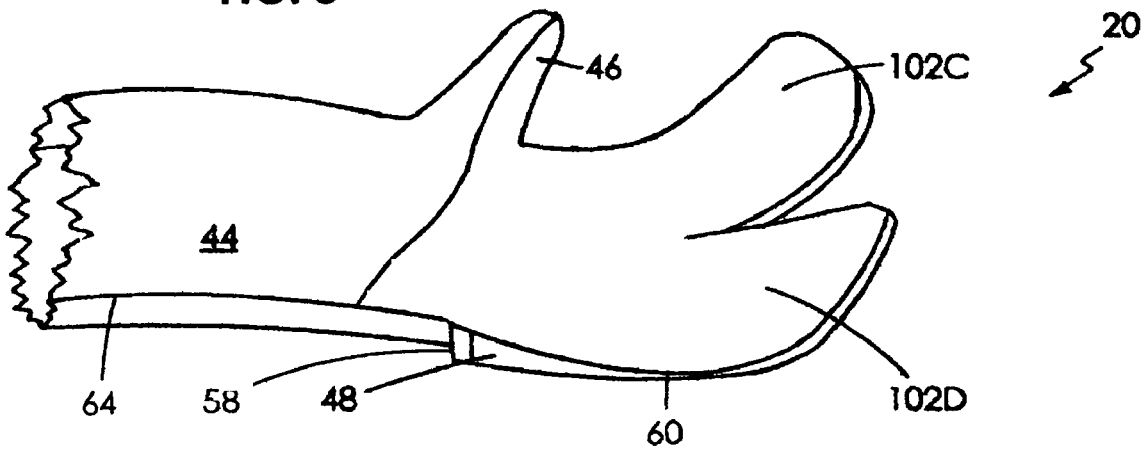

FIGS. 2, 3, and 4 show other exemplary embodiments of the mitt 20 which are adapted to separately enclose one or more fingers, not shown, in their own finger enclosures 102, 102A, 102B, 102C and 102D. Thus, in FIG. 2, the mitt 20 has a separate enclosure 102 for each of a person's four fingers, plus a thumb enclosure 46. The mitt 20 of FIG. 3 has a separate enclosure 102A for the first finger, i.e. "Trigger" finger, and an enclosure 102B for holding the other three fingers. In FIG. 4, a mitt 20 is shown which has enclosures 102C and 102D, each of which holds two fingers. Each mitt 20 of FIGS. 2, 3, and 4 is shown with a palm side 44 and a backside 64, a projecting thumb enclosure 46, and a two-way outer pocket 48 with pocket opening 58. The outer pocket 48 is configured to be foldable from its backside position 64 (as shown) to cover the finger enclosures 102 and thumb enclosure 46 as well. This action also exposes the terminal opening 18.

A description of the general construction, variants, and advantages of the mitt 20 is found in the applicant's co-application Ser. No. 10/079,118 filed Feb. 20, 2002, which is incorporated by reference herein.

Each mitt 20 of the invention may be formed as an extension of a lower sleeve portion 16 as seen in FIG. 24, or as an individual mitten unit which may be worn independently of any particular body garment (see the example in FIG. 1).

A first embodiment of hand covering 20 is shown in different modes of wear in FIGS. 5, 6, 7 and 8. The hand covering 20 includes a tubular portion 44 through which a wearer's hand 50 may pass. The tubular portion 44 has a terminal opening 18 at its distal end 66, and an integral thumb enclosure 46. A 2-way outer pocket 48 is attached, e.g. sewn on three sides 60 to peripheral portions of the frontside 62 of the tubular portion 44 of hand covering 20A. The fourth side of the pocket 48 comprises a pocket opening 58 into which the thumb enclosure 46 may be inserted when not in use. The hand covering 20A may include a thumb hole 70 near the distal end 66, through which a person's thumb 52 may be inserted when it is desired to expose a major portion of the fingers 54 and thumb 52 while keeping a person's palm 51 and hand backside 57 covered.

Figure 5:
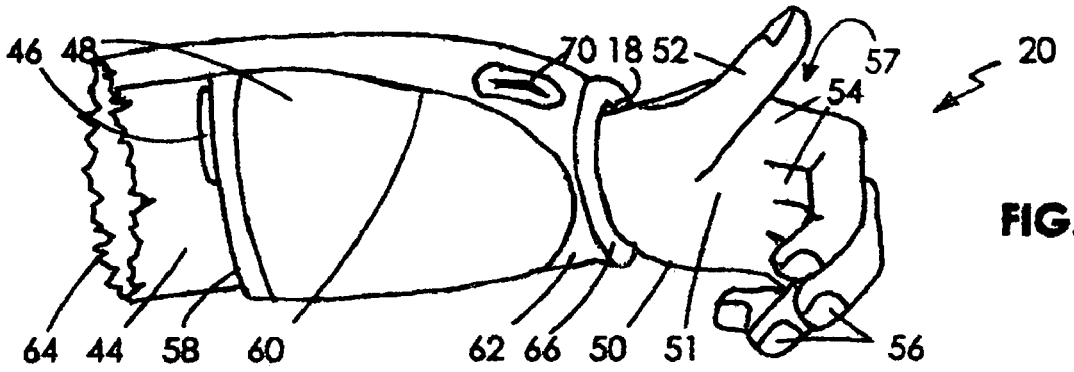
FIG. 5 is a general frontal view of a mitt embodiment of the invention with a person's hand fully exposed.

Turning now to the full-hand-exposure wearing mode of FIG. 5, it is evident that the thumb enclosure 46 is folded under the 2-way pocket 48 covering a portion of the front side 62 of the hand covering 20. The thumb enclosure 46 is thus retained in a non-interfering position where it is not visible. The full hand 50 is shown projecting from the exposed terminal opening 18, enabling full hand manipulation.

Figure 6:
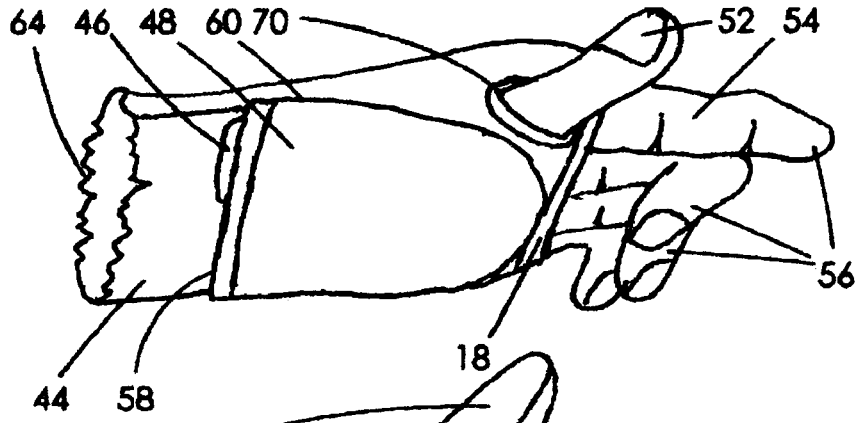
FIG. 6 is a general frontal view of a mitt embodiment of the invention with a person's palm and back covered but thumb and fingers exposed.

In FIG. 6, a wearer's hand 50 is withdrawn partially into the tubular portion 44 and the thumb 52 inserted through the thumb hole 70. The thumb hole 70 limits the extent to which the hand 50 may be uncovered. In this wearing mode, the fingers 54 and thumb 52 are largely uncovered while non-finger portions of the hand 50 are largely covered.

Figure 7:
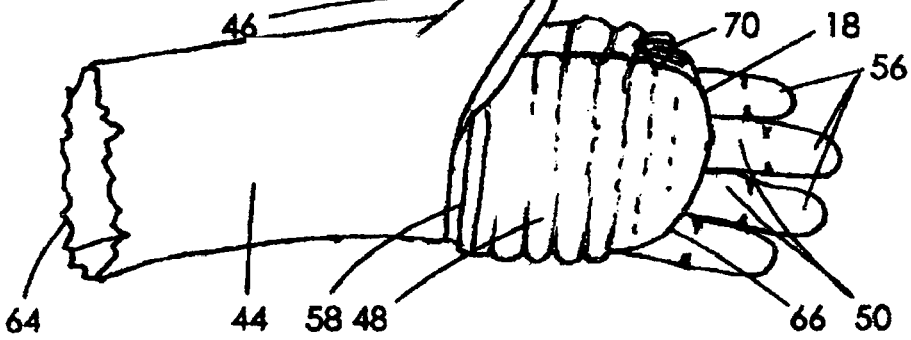
FIG. 7 is a general frontal view of a mitt embodiment of the invention with a person's fingertips exposed but thumb covered.

As shown in FIG. 7, the thumb enclosure 46 may be retracted from the 2-way pocket 48, and the wearer's thumb 52 inserted into the thumb enclosure 46 while further withdrawing the hand 50 into the tubular portion 44. The distal end 66 of the hand covering 20 may then be drawn back to expose the fingers 50 (particularly the finger tips 56) to any desired extent. In this "fingerless glove" wearing mode, the thumb 52 is enclosed and the fingertips 56 exposed. Thus, fingertip dexterity is assured without exposing the thumb 52.

Figure 8:
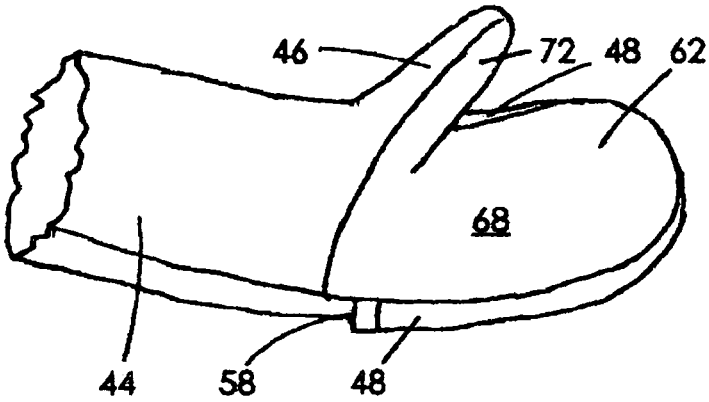
FIG. 8 shows a full covering mode of mitt wear.

As shown in FIG. 8, the 2-way pocket 48 may be pulled over the distal end 66 of the tubular portion 44, including opening 18, to form a full hand enclosure mode. A wearer's hand 50 is fully covered in this mode. The palm area 68 of the front side 62, together with the thumb underside 72, may be formed of a material which is conducive to the hand movements required by the particular activities of the wearer. For example, where the hands must form a tight grip on a rope, the palm area 68 and thumb underside 72 may be formed of a material with a non-slippery, wear-resistant surface.

The hand coverings 20 of the invention may generally be formed of a pliable and/or non-pliable material, or combinations thereof, preferably including a stretchable fabric such as a fleece, a hard-surfaced fleece, and/or a "shell" type material such as polytetrafluoroethylene (PTFE) such as available under the trademark GORTEX®. A variety of other fabrics may also be used to achieve the desired properties of stretch, non-slipperiness, strength, wear resistance, insulation value, sensory "feel", and cost.

Figure 9:
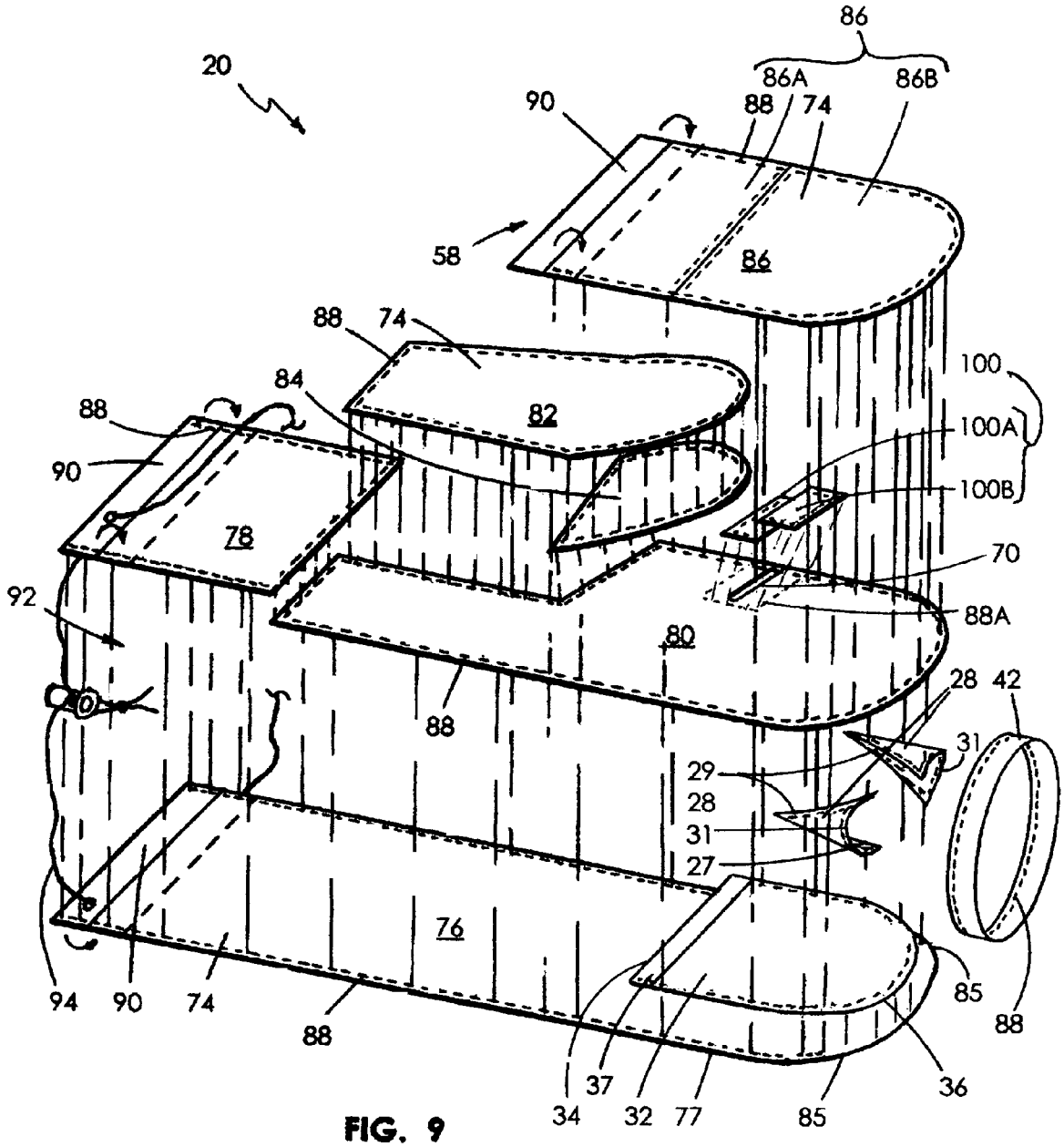
FIG. 9 is an exploded perspective view of the elements of a mitt embodiment of the invention including sew lines.

A hand covering 20 may be formed of a plurality of fabric panels such as depicted in the exploded view of FIG. 9, shown for fabricating a left hand mitt 20 with palm side up. As shown, a fabric or fabrics 74 may be cut to form a back panel 76, upper wrist panel 78, upper hand panel 80, upper thumb panel 82, underside thumb panel 84, and outer pocket panel 86. The panels are joined, as by sewing, along sew lines 88. Panels 78 and 86 are each shown with one or more folding ends 90 which are to be folded back and sewn to the panel, creating finished edges about the terminal opening 18, wrist opening 92, and pocket opening 58. This embodiment of the hand covering 20 is shown as a separate mitten, i.e. not part of a garment arm, and includes a cinch cord 94 contained within folded ends 90 of the wrist opening 92, for tightening about a wearer's wrist or lower arm. The particular material used to form each panel may vary depending upon the intended end use.

Preferably, the outer pocket panel 86 is two piece, with a first portion 86A comprising a stretch fabric along the pocket opening 58, and a second portion 86B comprising a durable material of limited stretchability. This combination of materials enables the pocket 86 to be easily moved between the front side (palm side) 62 and the back side 64.

In accordance with the invention, an inner finger pocket 32 is fixed, e.g. sewn along its non-open periphery 34 to the terminal portion 77 of back panel 76. The inner finger pocket 32 has an open end 34 into which a person's fingers 54 may be inserted. The inner finger pocket 32 is usable for finger warmth whether the mitt 20 is in a fully closed position or in a fully open position. It is very useful for temporary warmth when the fingers are otherwise required to be exposed for performing delicate tasks.

Also shown in FIG. 9 is a pair of panel-joining generally triangular fillets 28. Each fillet 28 has one edge 27 which is joined to a terminal end corner 83 of panel 80. Another edge 29 of fillet 28 is joined to a terminal end corner 85 of backside panel 76. The fillets 28 are typically made of a stretchable insulative material such as a fleece, and permit expansion of the terminal opening 18 for moving a person's hand 50 therethrough in either direction. A ring 42 of edging material may be sewn to the third edges 31 of fillets 28 and portions of panels 76 and 80, to define the terminal opening 18 and provide greater resistance to wear and strength of the mitt 20.

Another feature of the invention is an optional hole 70 through the upper hand panel 80 for exposing a finger 54 or thumb 52 from the inside of the mitt 20. As shown in FIG. 9, the hole 70 may comprise a slit, and has an overlying two-panel seal 100 of stretchable material. Seal 100 comprises two overlapping members 100A, 100B wherein the outer periphery of seal 100 is sewn to panel 80 about hole 70. In this configuration, a thumb or finger may be pushed through the seal. Hole 70 with seal 100 is positioned on panel 80 for easy access by the intended digit (finger 50 or thumb 52). The finger hole/thumb hole 70 may be of another shape such as, for example, elliptical or round.

The hand covering 20 may be formed from panels with shapes and sizes different from those shown in FIG. 9. For example, panels 78 and 80 may comprise a single panel. Alternatively, panels 76, 78 and 80 may together comprise a single panel which is folded, enabling formation of the tubular portion 44 by sewing their longitudinal edges together along one seam. Alternatively, panels 80 and 84 may be combined as a single panel, or panels 82 and 84 of the thumb enclosure may be formed in a single piece. Various other modifications in construction are possible.

For forming an aesthetic mitt 20, the various elements may be sewn in inverted form, i.e. wherein the formed mitt 20 is then inverted, i.e. turned inside out, to place the overlapping edges within the mitt rather than on the outside surface thereof. It is noted that the panels may alternatively be joined by an adhesive material or by a combination of sewing and adhesive.

Figure 10:
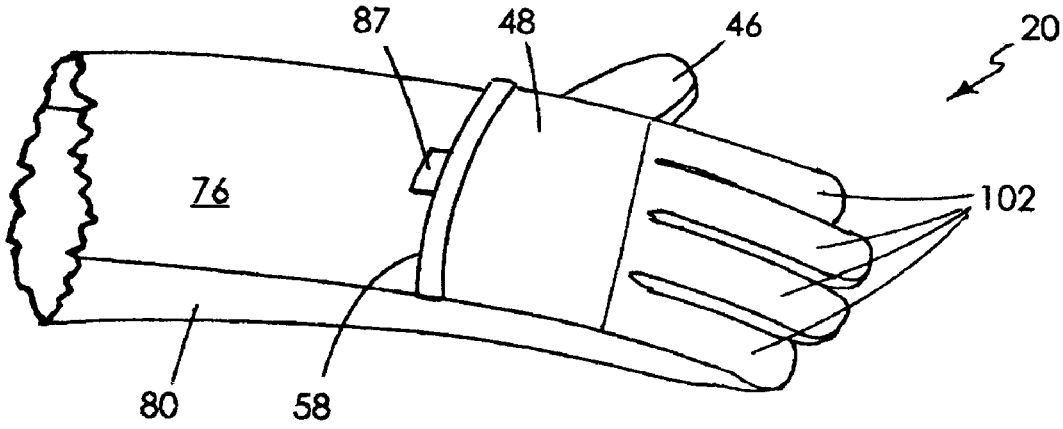
FIG. 10 is a perspective view of the backside of a multi-finger embodiment of a mitt of the invention in full hand covering mode.
Figure 11:
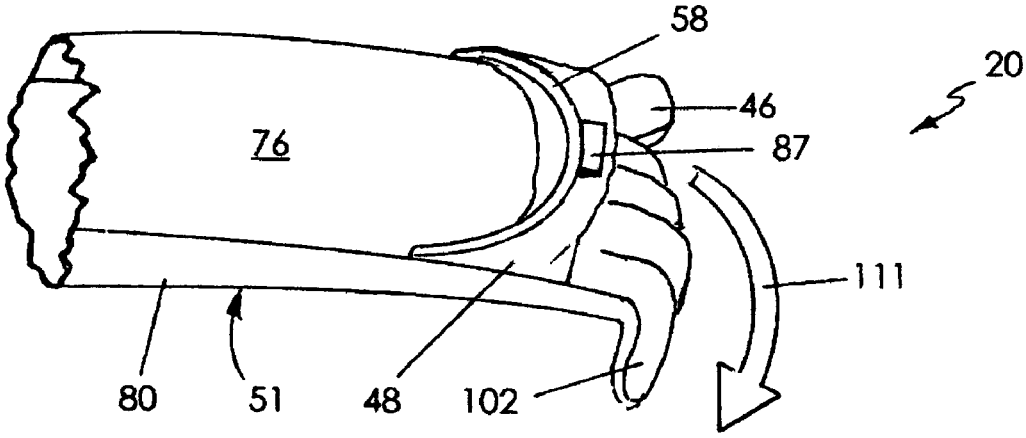
FIG. 11 is a perspective view of the backside of a multi-finger mitt of the invention being converted to a full hand exposure mode.
Figure 12:
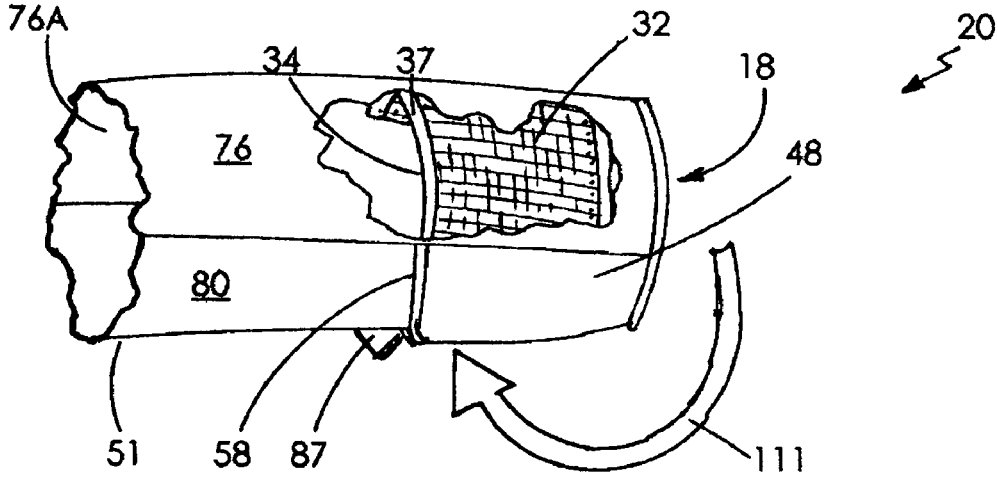
FIG. 12 is a perspective partially cutaway view of the backside of a multi-finger mitt of the invention in the full hand exposure mode.

FIGS. 10, 11, and 12 illustrate a method for changing the mode of a mitt 20 from a fully closed position to a fully open position. The method is depicted as applied to a glove-type mitt 20 having separate finger enclosures 102 and thumb enclosure. In FIG. 10, glove-type mitt 20 is depicted palm side down in a fully closed mode wherein a wearer's entire hand 50 including fingers 54 and thumb 52 is covered. In this mode, the two-way outer pocket 48 has its opening 58 on the backside panel 76 of the mitt 20. A pull tab 87 is shown attached to the pocket 48 to assist in pulling the pocket toward, and over, the finger enclosures 102.

As shown in FIG. 11, the pocket opening 58 has been pulled by tab 87 in the direction indicated by arrow 111, that is, over the finger enclosures 102. When the action is complete, as depicted in FIG. 12, the pocket 48 overlies the upper hand panel 80, that is, the palm side 51 of mitt 20. As depicted in FIG. 12, the thumb enclosure 46 may then be largely or totally enclosed within the two-way outer pocket 48, and the terminal opening 18 is opened for use by a wearer. The process may be simply reversed to restore the mitt 20 to a mode fully enclosing a person's hand 50 including thumb 52 and fingers 54. The cutaway portion of FIG. 12 reveals an inner finger-covering pocket 32 attached, e.g. sewn, on the inner surface 76A of back panel 76.

Figure 13:
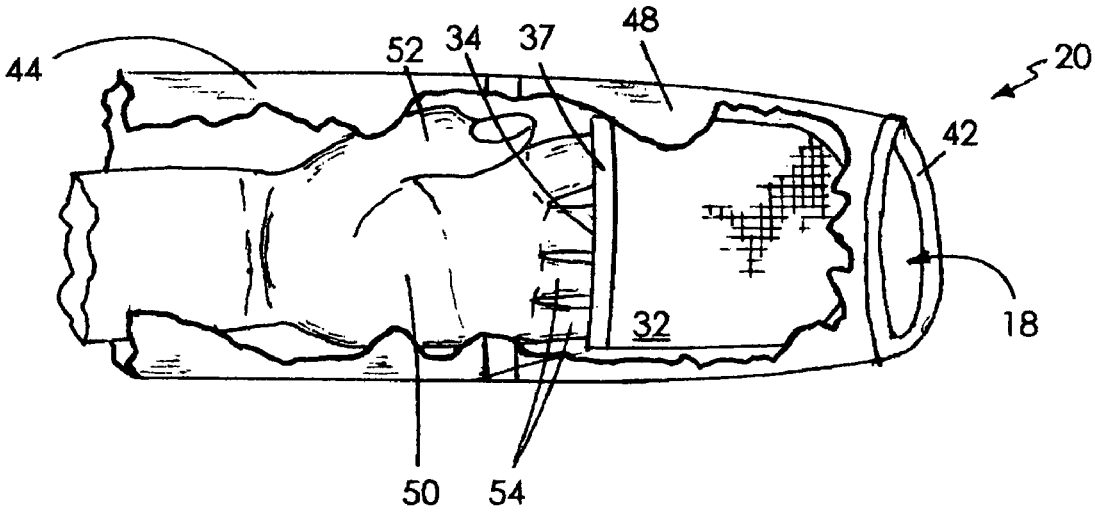
FIG. 13 is a cutaway view of the interior of the palm side of a mitt of the invention with a person's fingers in an inner finger pocket.

FIG. 13 depicts a person's hand 50 within a mitt 20 in an open mode, i.e. a person's hand may fully extend from the opening 18 for full exposure. However, as shown, a person may insert fingers 54 in the opening 34 of the finger pocket 32, keeping them warm. The fingers 54 are easily and quickly inserted and removed, making the pocket 32 very useful when activity requires finger exposure in cold weather.

Figure 14:
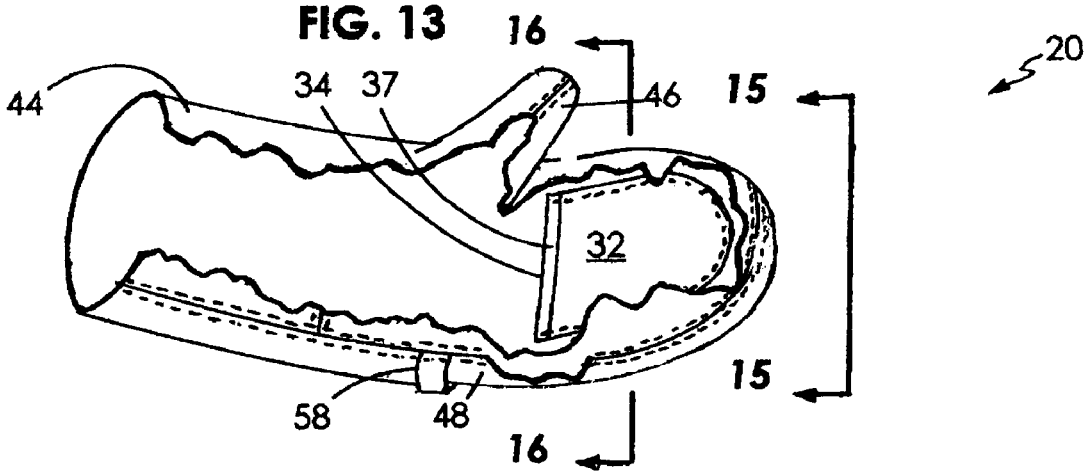
FIG. 14 is a perspective cutaway view of the palm side of a mitt of the invention, showing an inner finger pocket in accordance with the invention.

FIG. 14 shows the interior of the same mitt 20 in the fully closed mode. Finger pocket 32 may be used in the same way to enclose some or all of a person's fingers 54 which are inserted into pocket opening 34. Typically pocket opening 34 is reinforced by a band of material 37, as also shown in FIGS. 9, 12, and 13.

Figure 15:
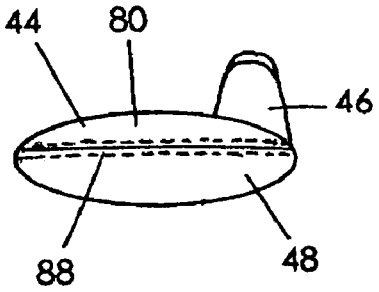
FIG. 15 is a cross-sectional end view of a mitt of the invention along lines 15-15 of FIG. 14.

FIG. 15 is an end view of a closed mitt 20. Visible are the outer pocket 48, upper hand panel 80, and thumb enclosure 46. The two panels 48, 80 are generally joined by sew line 88, as is panel 76, not visible in this figure. Together, panels 76 and 80 form a major part of the tubular portion 44 of the mitt 20.

Figure 16:
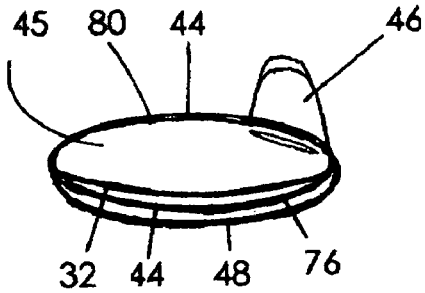
FIG. 16 is a cross-sectional end view of a mitt of the invention along lines 16-16 of FIG. 14.

In FIG. 16, the inner space 45 in tubular portion 44 is shown. Inside panel 76 is shown the inner finger pocket 32. Outside of panel 76 is shown the outer two-way pocket 48.

Figure 17:
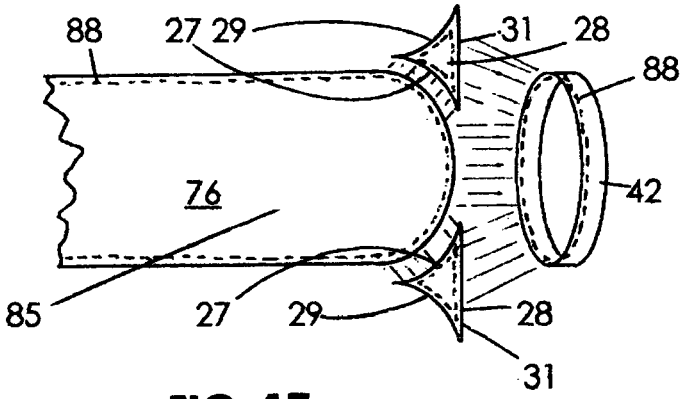
FIG. 17 is a plan view of a portion of an exemplary mitt backside of the invention showing conforming fillets.
Figure 17A:
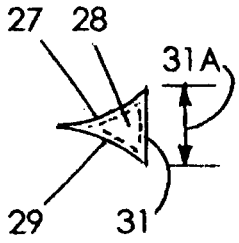
FIG. 17A is a plan view of another embodiment of a fillet in accordance with the invention.

Turning now to FIGS. 17-20, wherein another feature of the invention is illustrated. The terminal opening 18 of a mitt 20 may be formed to a reduced size with a stretchable material, thus snugly surrounding the wrist, hand 50 or fingers 54 of the wearer while allowing easy hand movement through the opening 18. A generally triangular fillet 28 has edges 27, 29, and 31 which are attached, as by sewing, respectively, to back panel 76, upper hand panel 80, and ring edging 42. The fillets 28 of FIG. 17 have surfaces 27, 29 which are configured to match the arcuate corner shape of panels 76 and 80. The opening size of the terminal opening 18 may be reduced by foreshortening the length 31A of edge 31, as depicted in FIG. 17A. However, the shape of the edges 27, 29 are maintained to match the corner shape of panels 76 and 80 to which they are attached.

Figure 18:
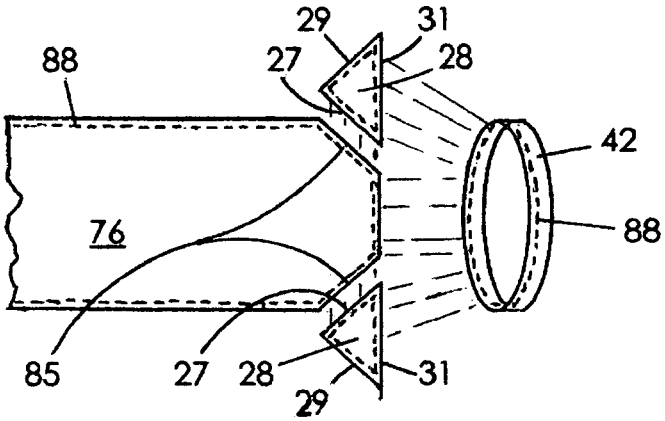
FIG. 18 is a plan view of a portion of an exemplary mitt backside of the invention showing alternative conforming fillets.
Figure 19:
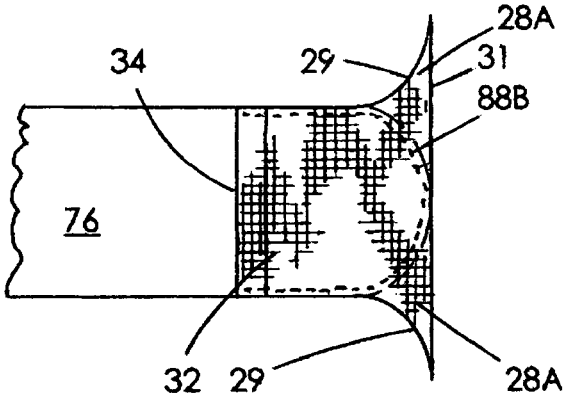
FIG. 19 is a plan view of a portion of an exemplary mitt backside of the invention having a one-piece inner pocket with integral conforming fillets.
Figure 20:
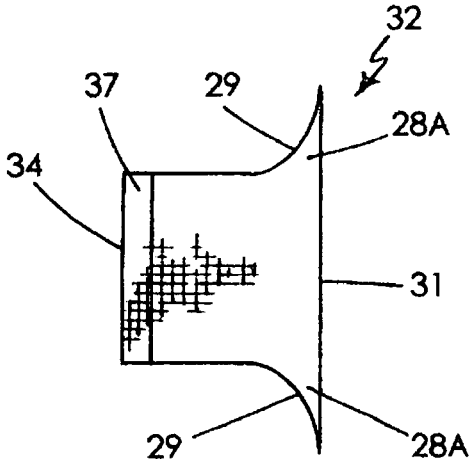
FIG. 20 is a plan view of a one-piece inner pocket with integral conforming fillets.

FIG. 18 shows an example of a different corner shape of panels 76 and 80, wherein the terminal panel corners 85 are simply truncated. Fillets 31 may be generally shaped to match the panel corners 85 regardless of the corner shape. It is understood that the fillets 31 may comprise part of another construction member. Thus, as shown in FIGS. 19 and 20, fillets 28A and 28B and inner finger pocket 32 are formed as one panel, eliminating the separate edges 31. This embodiment is possible where it is desirable to form the pocket 32 and fillets 28 of the same material.

It will be recognized from the above description that the various garment configurations of this invention enable a wearer to perform strenuous activities in greater comfort, safety and enjoyment than was previously attainable.

While the present invention has been disclosed herein in terms of certain exemplary embodiments, those of ordinary skill in the art will recognize and appreciate that it is not so limited. Many additions, deletions and modifications to the disclosed embodiments may be effected without departing from the scope of the invention. Moreover, features from one embodiment may be combined with features from other embodiments. The scope of the instant invention is only to be limited by the claims which follow.

What is claimed is:

1. A multi-mode hand covering for a person, comprising:

an elongate tubular portion having an inner space, a hand insertion end into which a person's hand may be inserted and a forward terminal end;

an opening in said terminal end through which said person's hand may be passed;

a palm side of said tube corresponding to a palm of said inserted hand;

a back side of said tube corresponding to a back side of said inserted hand;

a thumb enclosure extending outwardly from the palm side and communicating with said inner space for enclosing said person's thumb; and an exterior pocket extending generally from said terminal end to a pocket opening generally spanning said palm side proximate said thumb enclosure;

wherein said pocket is operable between a palm position wherein said terminal end opening is open to the atmosphere for passage of said person's hand therethrough for exposure thereof, and wherein said thumb enclosure is positioned within said pocket, and a back position covering said terminal end opening whereby said hand is fully covered; and an internal pocket having a generally upper opening, said pocket within said inner space for selectably enclosing at least a portion of said hand when said terminal end is open.

2. A multi-mode hand covering in accordance with claim 1, wherein said internal pocket is attached to said back side.

3. A multi-mode hand covering in accordance with claim 1, wherein said portion of said hand comprises at least a portion of said fingers and thumb on said hand.

4. A multi-mode hand covering in accordance with claim 1, wherein said internal pocket comprises thermally insulative material.

5. A multi-mode hand covering in accordance with claim 1, wherein said thumb enclosure is positionable within said pocket when said pocket is in said palm position.

6. A multi-mode hand covering in accordance with claim 1, further comprising at least one additional finger enclosure for separating said covered fingers.

7. A multi-mode hand covering in accordance with claim 6, wherein said at least one additional finger enclosure is positioned within said pocket when said pocket is in said palm position.

8. A multi-mode hand covering in accordance with claim 1, wherein said pocket includes a material of increased stretchability adjacent said pocket opening.

9. A multi-mode hand covering in accordance with claim 1, further comprising at least one of a thumb hole for exposing said thumb and a finger hole for selectably exposing a single one of said fingers.

10. A multi-mode hand covering in accordance with claim 9, further comprising a hole seal comprising:

a first flexible member attached along three edges to cover at least a major portion of said hole; and a second flexible member opposingly attached along three edges to cover at least a major portion of said hole and a portion of said first flexible member whereby said hole is covered when not in use and a finger may be inserted through said hole and said seal.

11. A multi-mode hand covering in accordance with claim 9, wherein said at least one of said thumb hole and said finger hole comprises one of an elongate slit, an oval, and a circle.

12. A multi-mode hand covering in accordance with claim 10, wherein said first and second flexible members are attached to one of the exterior surface of said hand covering and the interior surface of said hand covering.

13. A multi-mode hand covering in accordance with claim 1, wherein said hand covering comprises a unitary mitt.

14. A multi-mode hand covering in accordance with claim 1, wherein said hand covering is an integral part of a sleeve of an upper body garment.

* * * * *